US005097536A

United States Patent [19]

Cohen

[11] Patent Number: 5,097,536

[45] Date of Patent: Mar. 24, 1992

[54] MEDICAL EXAMINATION GARMENT

[75] Inventor: Robert A. Cohen, Atlanta, Ga.

[73] Assignee: Dignity Wear, Inc., Boca Raton, Fla.

[21] Appl. No.: 714,927

[22] Filed: Jun. 13, 1991

[51] Int. Cl.[5] ..... A41B 1/00; A41B 1/18; A41D 1/18; A41D 13/00

[52] U.S. Cl. ..... 2/114; 2/106; 2/115; 2/119; 2/DIG. 6; 2/DIG. 7

[58] Field of Search ..... 2/69, 75, 80, 104, 105, 2/106, 114, 115, 119, DIG. 6, DIG. 7

[56] References Cited

U.S. PATENT DOCUMENTS

| | | | |
|---|---|---|---|
| 302,901 | 8/1884 | Fenne | 2/114 |
| 715,248 | 12/1902 | Davis | 2/75 |
| 818,351 | 4/1906 | Clark | 2/114 |
| 1,489,046 | 4/1924 | Thompson | 2/114 |
| 1,766,272 | 6/1930 | Vallier | 2/114 |
| 1,998,051 | 4/1935 | Gerber | 2/114 |
| 2,124,366 | 7/1938 | DeLasarte | 2/114 |
| 2,585,840 | 2/1952 | Reynolds | 2/79 |
| 2,661,472 | 12/1953 | Miller | 2/105 X |
| 2,690,564 | 10/1954 | Kingston et al. | 2/105 |
| 4,031,566 | 6/1977 | Johnson | 2/104 |
| 4,382,303 | 5/1983 | Lunt | 2/75 X |
| 4,759,083 | 7/1988 | Belcher | 2/DIG. 7 X |
| 4,920,578 | 5/1990 | Janzen et al. | 2/114 |

FOREIGN PATENT DOCUMENTS

| | | | |
|---|---|---|---|
| 1474127 | 3/1967 | France | 2/DIG. 6 |
| 7905896 | 2/1980 | Netherlands | 2/119 |
| 23779 | 12/1893 | United Kingdom | 2/114 |

*Primary Examiner*—Werner H. Schroeder
*Assistant Examiner*—Jeanette E. Chapman
*Attorney, Agent, or Firm*—Kennedy & Kennedy

[57] ABSTRACT

A medical examination garment 10 has a back 11, a front yoke 24, repositionable right and left breast and axialla panels 25 and 26, and a front apron 27. The left breast and axilla panel is releasably fastened along its edges to releasable fasteners 23, 34 and 28 to secure the panel in a covered position. The right breast and axilla panel is releasably fastened along its edges to releasable fasteners 21, 33, 43 and 28 to secure the panel in a covered position.

6 Claims, 1 Drawing Sheet

MEDICAL EXAMINATION GARMENT

TECHNICAL FIELD

The invention relates generally to garments for use by medical patients, and specifically to medical examination garments for use by female patients undergoing mammographic examinations.

BACKGROUND OF THE INVENTION

For mammography examinations female patients must typically remove their clothing above the waist so that such may not interfere with the operation of radiological equipment. This is done at the expense of subjecting them to some embarrassment and exposure to the coolness of medical offices and hospitals. Therefore, some patients don examination gowns for this which are later lowered to provide a doctor with direct access to the patient's breasts and for placing radiological equipment in position without the gown intercepting and possibly interfering with radiation imaging. Though this does reduce the period of partial nudity, such still exposes more of the patient's body than need be. Thus, the patient may still be tense just at a time when it is important that she be as relaxed and comfortable as possible.

For conventional mammographic examinations a patient is positioned at an x-ray machine in a standing, sitting or reclined position, depending on the view to be taken. A breast is positioned against the machine and flattened between two plates. The breast is then typically x-rayed from the side and from above. Again, it is imperative that during x-raying of the breast and the adjacent axilla that no portion of a gown be positioned between the patient and the x-ray machine as this can cause false shadows to appear on the resulting x-ray photograph.

For the foregoing reasons, garments have been specially devised and tailored for use by patients undergoing mammography examinations. Exemplaries of these are those shown in U.S. Pat. Nos. 4,759,083 and 4,964,173. These garments are constructed so that they may be detached from the shoulder and side and folded longitudinally over a mid-section of the garment. Such garments may be suited for use where x-rays are taken from above with the patient in a sitting or standing position, but are ill-suited where x-ray images are taken with the patient lying down or where a side view is to be taken. This is because the unfastened portion of the gown tends to drape down over the breast with the patient in a reclined position. Furthermore, when the x-ray image is to be taken from the side, the garment tends to interfere with the portion of the x-ray machine which is positioned between the breasts. Moreover, even though only one breast may be exposed at a time, the possibility remains that the weight of the released portion may cause an accidental release of the retained portion. The sensing of this possibility can also cause the patient to feel insecure and anxious.

Accordingly, it is seen that a need remains for a medical examination garment which provides ready access to individual female breasts while still protecting the patient from embarrassment and chill and without interfering with the x-ray equipment. It is to the provision of such a garment therefore that the present invention is primarily directed.

SUMMARY OF THE INVENTION

In a preferred form of the invention, a garment adapted to be worn by a female patient for mammographic examinations and the like comprises a back, a front yoke, a front apron, a repositionable right breast and axilla panel and a repositionable left breast and axilla panel. The front yoke extends between opposite side of the back and is shaped to cover the front shoulder and throat portions of the patient above her breasts. The front apron also extends from opposite side of the back and is shaped to cover a front abdominal portion of the patient below her breasts. The repositionable right breast and axilla panel also extends from one side of the back and is shaped to cover the right breast and axilla of the patient. It has fastening means for releasably fastening it to the yoke for suspension therefrom. In like manner, the repositionable left breast and axilla panel extends from the other side of the back and is shaped to cover the left breast and axilla of the patient. Fastening means are also provided for releasably fastening it to the yoke for suspension therefrom.

DETAILED DESCRIPTION

Figure 1:
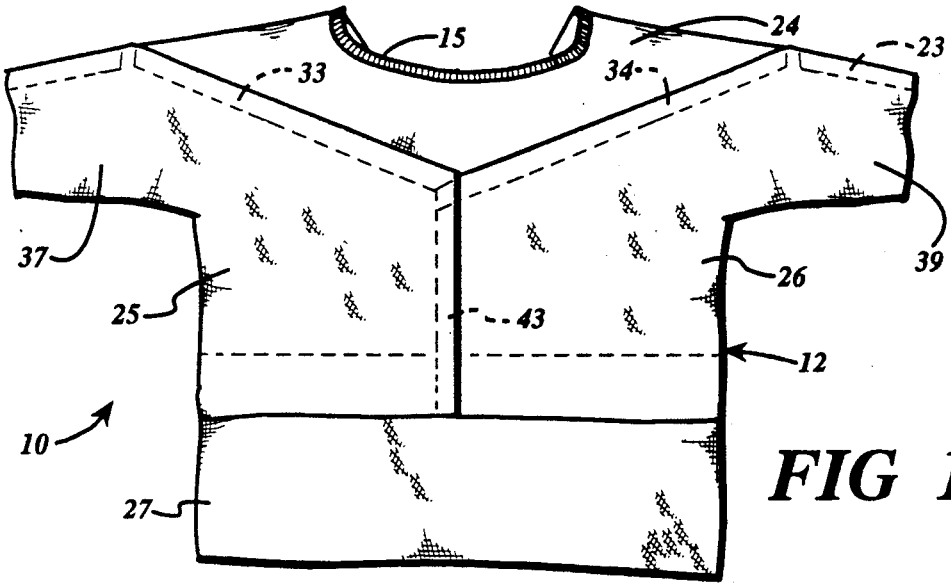
FIG. 1 is a front view of a medical examination garment that embodies principles of the invention in a preferred form.

With reference next to the drawings, there is shown a medical examination garment 10 adapted to be worn by a female patient which is preferably made of non-woven fabric. The garment 10 has a back 11 and a front 12. The back is formed with a right half-sleeve back portion 20 which bears a right sleeve fastening strip 21 on its outside adjacent its top edge and a left half-sleeve back portion 22 which bears a left sleeve fastening strip 23 on its outside adjacent its top edge. The back also has a longitudinal slit 17 which extends downwardly from a collar 15 and which is releasably held together by tie string 18.

The garment front 12 has a front yoke 24, a right breast and axilla panel 25, a left breast and axilla panel 26 and a front apron 27. The front yoke 24 extends between opposite upper sides of the back 11 and is shaped to cover the front shoulders and upper chest portion of the patient above her breasts B. The yoke 24 bears a right fastening strip 33 and a left fastening strip 34 on its outside adjacent its bottom edge. The front apron 27 extends between opposite lower sides of the back 11 and is shaped to cover a front abdominal portion of the patient below her breasts. The apron 22 bears an apron fastening strip 28 on its outside adjacent its top edge. It should be understood that the apron and back may be longer so that the garment is of a size of a customized examination gown.

The left breast and axilla panel 26 extends from the left side of the back 11 and the bottom of the left half-sleeve back portion 22 and is shaped to cover a left breast and left axilla of a patient. The panel thus includes a left half-sleeve front portion 39 that extends from the bottom of the left half-sleeve back portion 22. It has a top edge that overlays and is releasably fastened to the left sleeve fastening strip 23. The left breast and axilla panel has an top edge configured to overlay and be releasably fastened to the yoke left fastening strip 34 and a bottom edge configured to overlay and be releasably fastened to the apron fastening strip 28. The strip 28 may be eliminated, if desired, as it serves essentially only to prevent the middle of the apron from drooping. The left breast and axilla panel bears a panel fastening strip 43 on its outside adjacent its side edge that is overlaid by the right breast and axilla panel 25.

The right breast and axilla panel 25 extends from the right side of the back 11 and the bottom of the right half-sleeve back portion 20 and is shaped to cover a right breast and right axilla of a patient. The panel has a right half-sleeve front portion 37 extending from the bottom of the right half-sleeve back portion 20 and has a top edge configured to overlay and be releasably fastened to the right sleeve fastening strip 21. The right breast and axilla panel 25 has an top edge configured to overlay and be releasably fastened to the yoke right fastening strip 33 and a side edge configured to overlay and be releasably fastened to the left breast and axilla panel fastening strip 43. The right breast and axilla panel also has a bottom edge configured to overlay and may be releasably fastened to the apron fastening strip 28. Preferably the fastening strips are of the type that have interlockable fibers such as those sold under the name Velcro.

Figure 2:
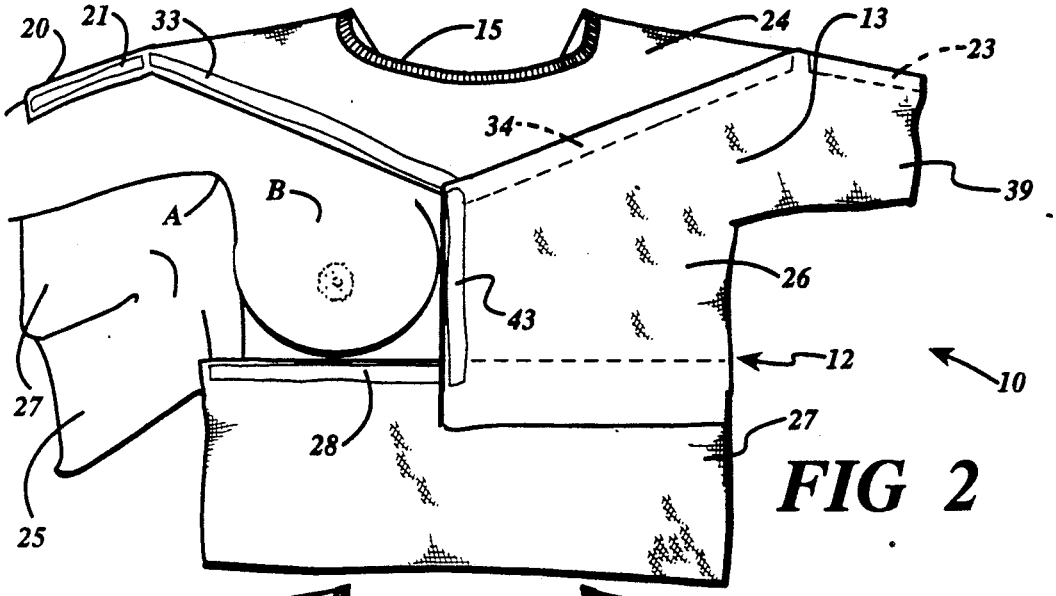
FIG. 2 is a front view of the medical examination garment of FIG. 1 showing a right breast and axilla panel positioned for patient breast examination.
Figure 3:
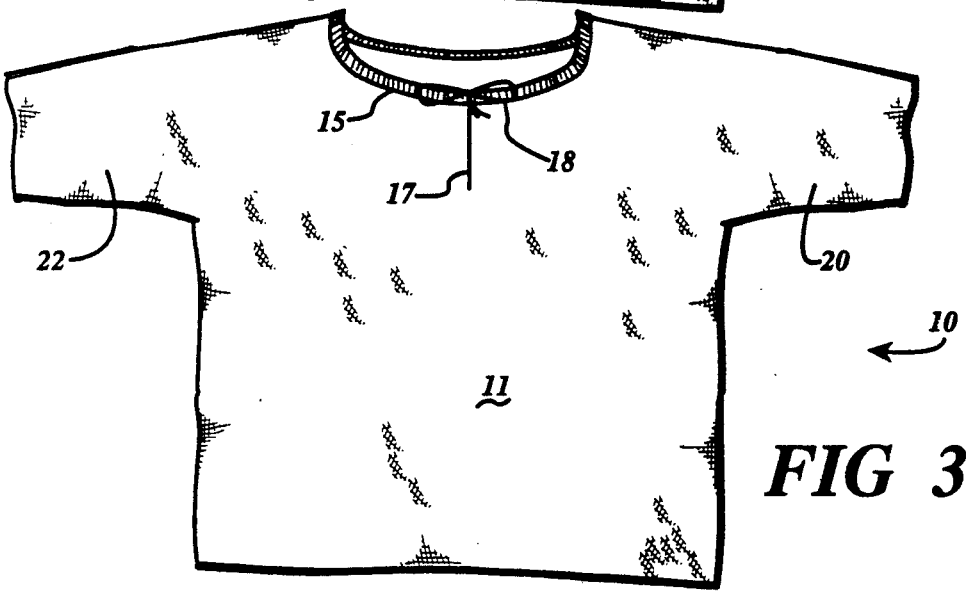
FIG. 3 is a rear view of the medical examination garment of FIG. 1.

For use, the garment is slipped on over a patient's head with the left and right breast and axilla panels fastened to each other and to the yoke and apron. This may be facilitated by opening the slit 17 in the back. To uncover the right breast B of the patient, the right breast and axilla panel 25 is detached from the left breast and axilla panel and from the yoke and apron. Once detached, the panel 25 is folded back laterally as shown in FIG. 2. In this manner the right breast B and right axilla A may be exposed for examination purposes. At the same time the patient's left breast remains covered as does her entire upper chest and abdomen. This serves to minimize any embarrassment and anxiety as well as to continue to provide warmth to most of her body. Because the breast and axilla panels are secured independently of each other to the yoke the threat of a panel accidentally disengaging is greatly reduced. This security is usually sensed by the patient, further contributing to her relaxation. With the right breast and axilla panel 25 positioned rearwardly along the fold, the x-ray machine may be positioned against both sides of the breast without interference by the garment. Similarly, to uncover the left breast and left axilla of the patient, the left breast and axilla panel 26 is disengaged from the right breast and axilla panel, the yoke and the apron and folded back laterally along the portion of the panel adjacent the back 11. If necessary, both breasts may be exposed simultaneously. Even with both panels disengaged the yoke and apron remains in place.

It thus is seen that a medical examination garment is now provided which overcomes problems associated with those of the prior art designed for mammographic examinations. It should however be understood that the just described embodiment merely illustrates principles of the invention in a preferred form. Many modifications, additions and deletions may, in addition to those expressly recited, be made without departure from the spirit and scope of the invention as set forth in the following claims.

I claim:

1. A garment adapted to be worn by a female patient for mammogaphic examinations and the like, and with the garment comprising a back, a font yoke that extends between opposite side of said back and is shaped to cover front shoulder and throat portions of the patient above her breasts, a lower front apron that extends between opposite side of said back and is shaped to cover a front abdominal portion of the patient below her breasts, a repositionable right breast and axilla panel that extends from the right side of said back shaped and sized to cover substantially all of the right breast of the patient and to overlap an upper portion of said apron, right fastening means for releasably fastening said right breast and axilla panel to said yoke for suspension therefrom, a repositionable left breast and axilla panel that extends from the left side of said back shaped and sized to cover substantially all of the left breast of the patient and to overlap an upper portion of said apron, and left fastening means for releasably fastening said left breast and axilla panel to said yoke for suspension therefrom.

2. The garment of claim 1 further comprising panel fastening means for releasably fastening said right breast and axilla panel and said left breast and axilla panel to each other.

3. The garment of claim 1 wherein said right breast and axilla panel and said left breast and axilla panel are shaped to overlap upper portions of said apron.

4. The garment of claim 1 further comprising apron fastening means for releasably fastening said right breast and axilla panel and said left breast and axilla panel to said apron.

5. The garment of claim 1 wherein said right breast and axilla panel is formed with a right front sleeve portion having a top, said left breast is formed with a left front sleeve portion having a top, said back is formed with a right back sleeve portion having a top and extending from the bottom of said right breast and axilla panel right front sleeve portion and a left back sleeve portion having a top and extending from the bottom of said left breast and axilla panel left front sleeve portion, and wherein said garment further comprises a right sleeve fastening means for releasably fastening said top of said right back sleeve portion and a left sleeve fastening means for releasably fastening said top of said left front sleeve portion to said top of said left back sleeve portion.

6. The garment of claim 1 wherein said yoke is of unitary construction.

* * * * *